US010781497B2

(12) United States Patent
Pilote et al.

(10) Patent No.: US 10,781,497 B2
(45) Date of Patent: Sep. 22, 2020

(54) METHOD OF SEALING AND REPAIRING A REFRACTORY TAP HOLE

(71) Applicant: Tata Steel Limited, Mumbai (IN)

(72) Inventors: Jacques Pilote, Woodlands (AU); Rodney James Dry, City Beach (AU)

(73) Assignee: Tata Steel Limited, Mumbai (IN)

( * ) Notice: Subject to any disclaimer, the term of this patent is extended or adjusted under 35 U.S.C. 154(b) by 259 days.

(21) Appl. No.: 15/538,452

(22) PCT Filed: Dec. 14, 2015

(86) PCT No.: PCT/AU2015/050790
§ 371 (c)(1),
(2) Date: Jun. 21, 2017

(87) PCT Pub. No.: WO2016/101020
PCT Pub. Date: Jun. 30, 2016

(65) Prior Publication Data

US 2017/0342513 A1 Nov. 30, 2017

(30) Foreign Application Priority Data

Dec. 23, 2014 (AU) ..... 2014905218

(51) Int. Cl.
*C21B 7/12* (2006.01)
*B22D 41/18* (2006.01)
*F27D 3/15* (2006.01)

(52) U.S. Cl.
CPC ..... *C21B 7/125* (2013.01); *B22D 41/18* (2013.01); *F27D 3/1536* (2013.01); *C21B 7/12* (2013.01)

(58) Field of Classification Search
CPC ..... B22D 41/18; C21B 7/12; C21B 7/125; F27D 3/1536
(Continued)

(56) References Cited

U.S. PATENT DOCUMENTS 1,775,396 A * 9/1930 Jackman et al. ..... C04B 35/66 52/596
4,022,739 A * 5/1977 Bove ..... B22D 41/46 523/140
(Continued)

FOREIGN PATENT DOCUMENTS

JP H08150449 * 6/1996 ..... C21B 7/125
JP H08150449 A 6/1996
(Continued)

OTHER PUBLICATIONS

JPH08150449, Yuichi et al. , method of discharging slag in tundish, Jun. 11, 1996, Espacenet Machine translation version , abstract, Description, claims , Drawing. (Year: 1996).*
(Continued)

*Primary Examiner* — Jesse R Roe
*Assistant Examiner* — Michael Aboagye
(74) *Attorney, Agent, or Firm* — Banner & Witcoff, Ltd.

(57) ABSTRACT

A method of sealing a slag drain in a direct smelting vessel is disclosed. Also disclosed are a method of maintaining a slag drain channel and a direct smelting vessel with a slag drain channel that extends through a sleeve of refractory material installed in the direct smelting vessel. The method for sealing the slag drain includes locating a pre-formed refractory material at an inlet end of the slag drain channel so that it is exposed to a molten bath contained within the direct smelting vessel and sealing the slag drain channel with sealing material downstream of the pre-formed refractory material.

16 Claims, 4 Drawing Sheets

(58) Field of Classification Search
USPC ..... 266/45, 227, 176, 135, 195, 236; 432/250
See application file for complete search history.

(56) References Cited

U.S. PATENT DOCUMENTS

| | | | | |
|---|---|---|---|---|
| 6,281,266 | B1 * | 8/2001 | Takeda | B22D 41/46 501/100 |
| 7,201,868 | B2 | 4/2007 | Ions et al. | |
| 7,914,601 | B2 * | 3/2011 | Farr | C21B 11/08 75/503 |
| 8,216,954 | B2 * | 7/2012 | Dunn | C04B 35/1015 266/45 |

FOREIGN PATENT DOCUMENTS

| | | | |
|---|---|---|---|
| WO | 9631627 | A1 | 10/1996 |
| WO | 00/022176 | A1 | 4/2000 |
| WO | 2013/0150421 | A1 | 10/2013 |

OTHER PUBLICATIONS

Mar. 2, 2016—International Search Report and Written Opinion of PCT/AU2015/050790.

* cited by examiner

METHOD OF SEALING AND REPAIRING A REFRACTORY TAP HOLE

CROSS-REFERENCE TO RELATED APPLICATIONS

The present application is a U.S. National Phase filing of International Application No. PCT/AU2015/050790, filed on Dec. 14, 2015, designating the United States of America and claiming priority to Australian Patent Application No. 2014905218 filed Dec. 23, 2014. The present application claims priority to and the benefit of all the above-identified applications, which are all incorporated by reference herein in their entireties.

TECHNICAL FIELD

This invention relates to metallurgical vessels that contain a molten bath of slag and molten metal. More particularly, it relates to vessels that are periodically drained of slag, typically to facilitate vessel maintenance.

The invention relates to a method of maintaining the slag drain in the circumstances that the slag chemistry damages refractory that forms a slag drain channel. The invention has particular application, although not exclusive application, to metallurgical vessels for the direct smelting of metalliferous material to molten metal.

BACKGROUND

A known molten bath-based smelting process is generally referred to as the "HIsmelt" process and is described in a considerable number of patents and patent applications in the name of the applicant.

The HIsmelt process is applicable to smelting metalliferous material generally but is associated particularly with producing molten iron from iron ore or another iron-containing material.

In the context of producing molten iron, the HIsmelt process includes the steps of:

(a) forming a bath of molten iron and slag in a main chamber of a direct smelting vessel;

(b) injecting into the molten bath: (i) iron ore, typically in the form of fines; and (ii) a solid carbonaceous material; typically coal; which acts as a reductant of the iron ore feed material and a source of energy; and (c) smelting iron ore to iron in the bath.

The term "smelting" is herein understood to mean thermal processing wherein chemical reactions that reduce metal oxides take place to produce molten metal.

In the HIsmelt process solid feed materials in the form of metalliferous material (which may be pre-heated) and carbonaceous material and optionally flux material are injected with a carrier gas into the molten bath through a number of water-cooled solids injection lances which are inclined to the vertical so as to extend downwardly and inwardly through the side wall of the main chamber of the smelting vessel and into a lower region of the vessel so as to deliver at least part of the solid feed materials into the metal layer in the bottom of the main chamber. The solid feed materials and the carrier gas penetrate the molten bath and cause molten metal and/or slag to be projected into a space above the surface of the bath and form a transition zone. A blast of oxygen-containing gas, typically oxygen-enriched air or pure oxygen, is injected into an upper region of the main chamber of the vessel through a downwardly extending lance to cause post-combustion of reaction gases released from the molten bath in the upper region of the vessel. In the transition zone there is a favourable mass of ascending and thereafter descending droplets or splashes or streams of molten metal and/or slag which provide an effective medium to transfer to the bath the thermal energy generated by post-combusting reaction gases above the bath.

Typically, in the case of producing molten iron, when oxygen-enriched air is used, the oxygen-enriched air is generated in hot blast stoves and fed at a temperature of the order of 1200° C. into the upper region of the main chamber of the vessel. If technical-grade cold oxygen is used, the technical-grade cold oxygen is typically fed into the upper region of the main chamber at or close to ambient temperature.

Off-gases resulting from the post-combustion of reaction gases in the smelting vessel are taken away from the upper region of the smelting vessel through an off-gas duct.

The smelting vessel includes a main chamber for smelting metalliferous material and a forehearth connected to the main chamber via a forehearth connection that allows continuous metal product outflow from the vessel. The main chamber includes refractory-lined sections in a lower hearth and water-cooled panels in side walls and a roof of the main chamber. Water is circulated continuously through the panels in a continuous circuit. The forehearth operates as a molten metal-filled siphon seal, naturally "spilling" excess molten metal from the smelting vessel as it is produced. This allows the molten metal level in the main chamber of the smelting vessel to be known and controlled to within a small tolerance this is essential for plant safety.

Another process for smelting a metalliferous material is referred to hereinafter as the "HIsarna" process. The process is carried out in a smelting apparatus that includes (a) a smelting vessel that includes solids injection lances and oxygen-containing gas injection lances and is adapted to contain a bath of molten metal and (b) a smelt cyclone for pre-treating a metalliferous feed material that is positioned above and communicates with the smelting vessel. The HIsarna process and apparatus are described in International application PCT/AU99/00884 (WO 00/022176) in the name of the applicant.

The term "smelt cyclone" is understood herein to mean a vessel that typically defines a cylindrical chamber and is constructed so that feed materials supplied to the chamber move in a path around a vertical central axis of the chamber and can withstand high operating temperatures sufficient to at least partially smelt metalliferous feed materials.

In one form of the HIsarna process, carbonaceous feed material (typically coal) and flux (typically limestone) are injected into a molten bath in the smelting vessel. Metalliferous feed material, such as iron ore, is injected into and heated and partially melted and partially reduced in the smelt cyclone. This molten, partly reduced metalliferous material flows downwardly from the smelt cyclone into the molten bath in the smelting vessel and is smelted to molten metal in the bath. Hot, reaction gases (typically CO, $CO_2$, $H_2$, and $H_2O$) produced in the molten bath are partially combusted by oxygen-containing gas (typically technical-grade oxygen) in an upper part of the smelting vessel. Heat generated by the post-combustion is transferred to molten material in the upper section that falls back into the molten bath to maintain the temperature of the bath. The hot, partially-combusted reaction gases flow upwardly from the smelting vessel and enter the bottom of the smelt cyclone. Oxygen-containing gas (typically technical-grade oxygen) is injected into the smelt cyclone via tuyeres that are arranged in such a way as to generate a cyclonic swirl pattern in a horizontal plane, i.e. about a vertical central axis of the chamber of the smelt cyclone. This injection of oxygen-containing gas leads to further combustion of smelting vessel gases, resulting in very hot (cyclonic) flames. Finely divided incoming metalliferous feed material is injected pneumatically into these flames via tuyeres in the smelt cyclone, resulting in rapid heating and partial melting accompanied by partial reduction (roughly 10-20% reduction). The reduction is due to CO and $H_2$ in the reaction gases from the smelting vessel. The hot, partially melted metalliferous feed material is thrown outwards onto the walls of the smelt cyclone by cyclonic swirl action and, as described above, flows downwardly into the smelting vessel below for smelting in that vessel.

The net effect of the above-described form of the HIsarna process is a two-step countercurrent process. Metalliferous teed material is heated and partially reduced by outgoing reaction gases form the smelting vessel (with oxygen-containing gas addition) and flows downwardly into the smelting vessel and is smelted to molten iron in the smelting vessel. In a general sense, this countercurrent arrangement increases productivity and energy efficiency.

In both the HIsmelt process and the HIsarna process, the slag inventory in the smelting vessel is reduced by tapping from a slag tap hole to maintain an inventory that is suitable for operating the process. The solids injection lances, however, also require periodic maintenance, for example, to replace a wear resistant liner. This involves reducing the level of the molten bath by draining of slag through the slag drain through the refractory wall of the refractory lined hearth until that the outlet ends of the solids injection lances are spaced above the molten bath. However, the relatively high FeO content in the slag is very aggressive toward the refractory lining. For this reason, sections of the vessel exposed to slag splashing are water-cooled so as to form a frozen layer of slag on the refractory lining. The frozen slag protects the refractory lining from further corrosion.

In the case of the slag drain, a frozen layer of slag is particularly difficult to form because the surrounding refractory is not water-cooled as it is located very close to the metal-slag interface. Additionally, the slag drain is plugged by extruding a plugging mass (typically made of refractory mixed with tar or phenolic resin). In the HIsmelt oxidising slag conditions and by its turbulent nature, the normal plugging mass degrades quickly and leaves the refractory lined slag drain channel to wear so that a funnel-shaped corrosion pattern forms (see FIG. 3).

The corrosion ultimately reaches a point where the refractory which forms the slag drain requires replacement. This is carried out by shutting down the operation, i.e. by stopping production and draining the vessel of molten metal and slag and allowing the vessel to cool. Consequently, replacing the slag drain refractory can result in a month or more of vessel down-time and, therefore, result in a significant loss of productivity.

Furthermore, re-starting the vessel typically requires supply of molten metal (100 to 200 tonnes depending on the size of the vessel) from an external source. This adds a level of complexity and cost to maintenance operations.

The above description is not to be taken as an admission of the common general knowledge in Australia or elsewhere.

SUMMARY OF THE DISCLOSURE

The present invention is based on the realisation that the refractory corrosion around the inlet end of the slag drain can be reduced by locating a pre-formed refractory plug, that is similarly corrosion resistant to the surrounding refractory lining, in the inlet end. The applicant expects that that refractory that lines the slag drain channel and that surrounds the inlet end will be subject to less slag washing than the plugging mass used to seal the slag drain because the pre-formed refractory plug is formed of a material that is much more stable in the normal HIsmelt operating condition.

Having the pre-formed refractory plug formed of a material that is similarly corrosion resistant to the slag as the surrounding refractory lining is expected to result in refractory corrosion that is more consistent with refractory corrosion elsewhere in the vessel. In other words, it is expected that the funnel-shaped corrosion pattern will be substantially reduced and possibly eliminated. This means that the frequency of refractory maintenance will be reduced because the slag drain corrosion rate will be lower. It also means that a slag drain can be carried out by drilling (in the usual manner with existing equipment) through the pre-formed refractory plug, draining the slag and then plugging the slag drain with another pre-formed refractory plug.

Accordingly, the invention provides in one aspect a method of sealing a slag drain in a direct smelting vessel for containing a molten bath of slag and molten metal, the direct smelting vessel comprising at least one solids injection lance extending downwardly and inwardly through a refractory-lined side wall of the vessel for injecting metalliferous material and/or carbonaceous material, the slag drain comprising a slag drain channel extending from an inlet end at an inner surface of the refractory-lined side wall in the direct smelting vessel, the inlet end being exposed to the molten bath, to a location at or near an exterior of the direct smelting vessel, the method comprising locating a pre-formed refractory material at the inlet end of the channel so that it is exposed to the molten bath and sealing the channel with sealing material downstream of the pre-formed refractory material.

The pre-formed refractory material may be positioned substantially flush with the inner surface of the refractory-lined side wall. In this manner, the pre-formed refractory material and the surrounding refractory lining form a generally continuous surface so that slag washing over the surface does not concentrate corrosion at the inlet or within the slag channel adjacent the inlet.

An end face of the pre-formed refractory material may be positioned within 5 centimeters of the inlet end of the channel. It is expected that when the pre-formed refractory material projects into the vessel beyond the inlet end of the channel, it will be subject to accelerated corrosion on account of the exposure to slag washing in the vessel. The corrosion will ultimately reduce the exposure so that the pre-formed refractory material will form a generally continuous surface with the surrounding refractory. The same applies in the circumstances that the exposed end of the pre-formed refractory material is recessed from the inlet, in which case the refractory surrounding the inlet will experience accelerated corrosion until a substantially continuous surface is formed.

The pre-formed refractory material may have similarly corrosion resistant properties to the surrounding refractory lining.

The term "similar" in the context of comparing the corrosion resistant properties of two refractory materials is a reference to the amount of material removed (by reference to dimension change) from a refractory material over a period of time when exposed to certain conditions within the direct smelting vessel being within 20% of the amount of material removed from another refractory material when exposed to the same conditions over the same period of time. For example, two different refractories located side-by-side in a direct smelting vessel and exposed to the same slag washing condition have similar corrosion resistant properties if the exposed surface of one refractory material recedes over a period of time by a distance that is 80% to 120% of the distance that the exposed surface of the other refractory material recedes. In other words, any mismatch between the extents to which the surfaces recede is within 20% of the total recession distance.

The sealing material introduced downstream of the pre-formed refractory material may include the alumina-based plugging material.

The sealing material introduced downstream of the pre-formed refractory material may include tar or phenolic-based plugging mass downstream of the alumina-based plugging material.

The pre-formed refractory material may extend occupy 5 to 20% of the total length of the slag drain channel.

The pre-formed refractory material may be a solid chrome-based refractory material at the time that it is located within the channel.

The pre-formed refractory material may be a refractory brick.

Another aspect of the invention is based on the realisation that repair work to replace corroded refractory lining can be carried out while the molten metal and slag remain in the vessel. In particular, the applicant has found that by momentarily increasing the pressure in the vessel and tapping molten metal through a dedicated tap hole in the wall of the forehearth it is possible to move the metal interface low enough to safely maintain the refractory lined tap holes (slag drain and dedicated forehearth metal drain). If the slag and molten metal were tapped only to the level of the slag drain, excavation of refractory surrounding the slag drain and below the level of the slag drain would result in slag or molten metal spilling out of the vessel through the section of excavated refractory. Therefore, the corrosion pattern around the bottom side of the slag drain could not be removed and replaced. By excavating the refractory forming the trumpet-shape corrosion pattern, new refractory can be installed so that the refractory wall surrounding the slag drain is generally flush with the inner surface of the refractory lining.

This is an important realisation because it avoids having to specifically shut-down operations, drain the vessel and allow it to cool. Instead, the metallurgical process is stopped for the duration of the refractory repair work which is undertaken simultaneously with other normal periodic plant maintenance activities. However, the impact on the loss of productivity is very significantly reduced when compared to the loss of productivity that is associated with the typical maintenance method which involves a vessel shut-down. There is also substantial associated benefit for the refractory in avoiding the end-tap and cool-down of the vessel.

The realisation that refractory repair work can be carried out while molten metal and slag remain in the vessel is an important realisation also because it enables the metallurgical process to be re-started relatively quickly as a result of the vessel remaining hot and as a result of retaining sufficient slag and molten metal to avoid the need for a top-up of molten metal from an external source.

According to this aspect of the present invention, there is provided a method of maintaining a slag drain channel formed in refractory lining of a direct smelting vessel that contains a molten bath of slag and molten metal and that has a forehearth with an overflow weir for discharging molten metal, the method including:

(a) reducing the slag and metal inventory from the inventory under normal operating conditions;

(b) temporarily plugging the slag drain hole for stopping the slag flow when the level is deemed low enough for allowing further maintenance activities;

c) opening a tap hole located in the forehearth, below the overflow weir, for tapping further metal;

(d) temporarily increasing gas pressure in the direct smelting vessel to cause molten metal to flow from the direct smelting vessel into the forehearth to further decrease the metal level in the vessel to be below the slag drain and the forehearth tap hole when the gas pressure in the vessel is reduced to atmospheric pressure.

(e) adjusting the pressure in the vessel to be atmospheric pressure and removing a section of refractory lining surrounding the slag drain channel to form an enlarged channel and installing a refractory sleeve in the enlarged channel, the sleeve including a channel for draining slag.

Similar repair techniques can also apply to the metal tap hole in the forehearth wall.

The method may include a further step (t) which includes finally plugging both the slag drain hole and the forehearth tap hole.

The applicant expects that the method will reduce the frequency of vessel shut-downs, thereby increasing the length of smelting campaigns, because the refractory repair can be carried out while the vessel remains hot. The applicant also expects the overall life of the refractory to be extended and this will also reduce the occurrence of major shutdown periods.

The method may include locating a refractory brick in an inlet end of the slag drain channel in the refractory sleeve and back-filling the channel with a filler to close the slag drain channel.

Back-filling the slag drain channel may include delivering an alumina-based plugging material into the slag drain channel downstream of the refractory brick.

Back-filling may further include delivering tar or phenolic-based plugging mass into the slag drain channel downstream of the alumina-based plugging material.

The refractory brick may be a chrome-based refractory brick.

Increasing the pressure in the vessel may include increasing the pressure by 5 to 50 kPa. The pressure may be increased by 10 to 20 kPa.

The method may include completing the maintenance within 18 hours. Optionally, the method may be completed within 12 hours.

The method may further include maintaining sufficient slag and molten metal in the vessel to enable commencement of a direct smelting process without additional input of molten metal to the vessel from an external supply.

The direct smelting process may be commenced by supplying solids feed materials to the molten bath after step (f) is completed.

The method may include causing the temporary pressure increase by controlling the flow of vessel off-gas through downstream off-gas processing operations.

According to another aspect of the present invention, there is provided a direct smelting vessel lined with a refractory-lined sections for containing a molten bath of slag and molten metal, the direct smelting vessel including a slag drain that includes a sleeve of refractory material installed in the refractory lining and including a slag drain channel through the sleeve and wherein an inlet end of the slag drain is plugged with a pre-formed refractory brick.

The sleeve may be installed according to the method described above for maintaining a slag drain.

The direct smelting vessel may include one or more solids injection lance extending downwardly and inwardly through a side wall of the direct smelting vessel for injecting metalliferous material and/or carbonaceous material into the molten bath.

The direct smelting vessel may include one or more lances for injecting oxygen-containing gas into a gas space in the direct smelting vessel above the molten bath.

The direct smelting vessel may include a forehearth that, during normal production, continuously taps molten metal from the vessel via an overflow weir and that includes a tap hole below the overflow weir to decrease the metal in the direct smelting vessel to below the level of the slag drain.

The direct smelting vessel may be a HIsmelt or a HIsarna vessel.

BRIEF DESCRIPTION OF THE DRAWINGS

The invention is described further, by way of example only, with reference to the accompanying drawings, of which.

DESCRIPTION OF EMBODIMENT

Although the following description is in the context of a HIsmelt vessel, it will be appreciated that the invention is applicable to other direct smelting vessels that contain a molten bath of slag and molten metal, including HIsarna vessels.

Figure 1:
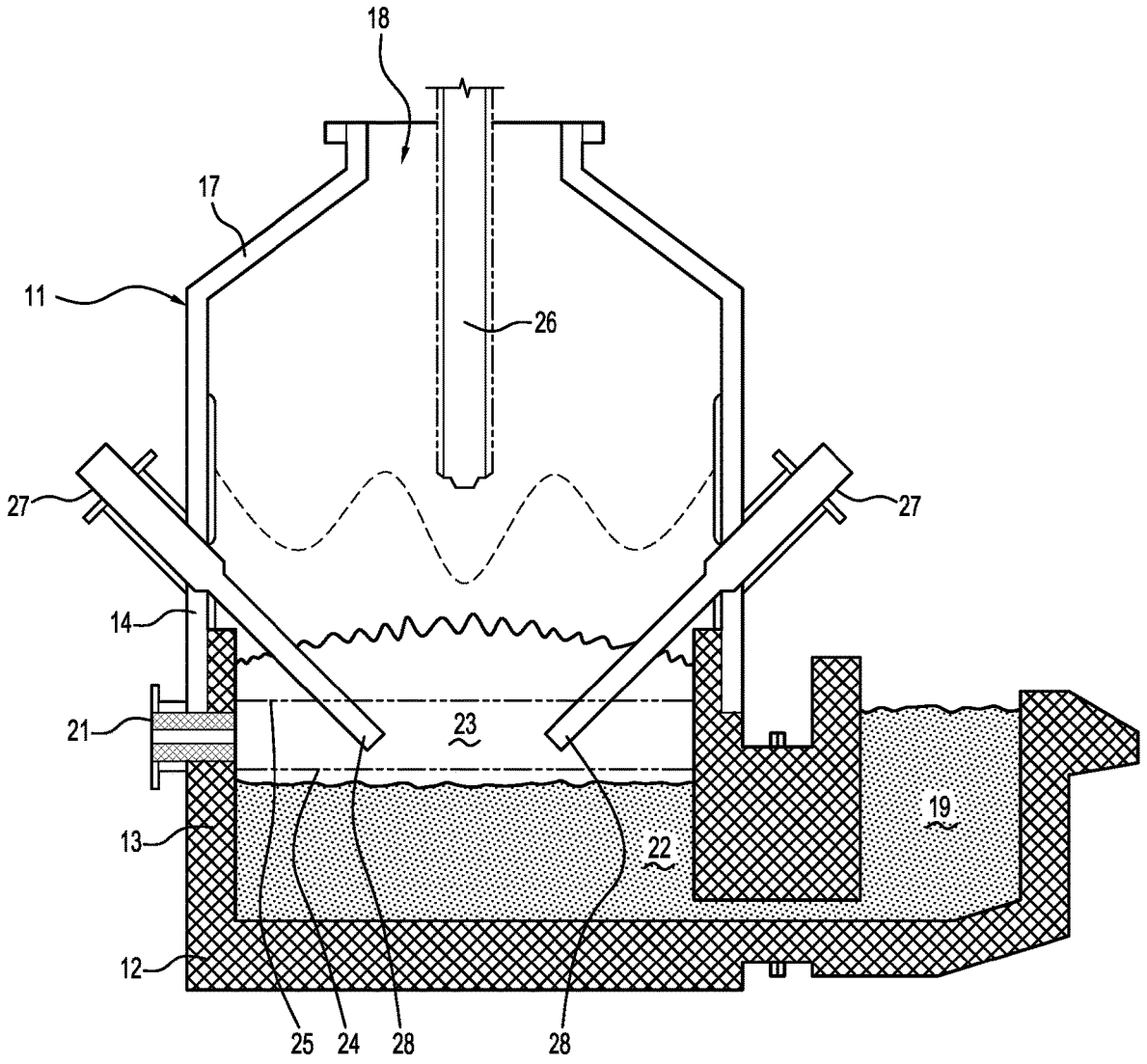
FIG. 1 is a vertical cross-section through a HIsmelt direct smelting vessel.

FIG. 1 shows a direct smelting vessel 11 that is suitable particularly for carrying out the HIsmelt process as described by way of example in international patent application PCT/AU96/00197 (WO 1996/031627) in the name of the applicant.

The following description is in the context of smelting iron ore fines to produce molten iron in accordance with the HIsmelt process.

It will be appreciated that the present invention is applicable to smelting any metalliferous material, including ores, partly reduced ores, and metal-containing waste streams via any suitable molten bath-based direct smelting process and is not confined to the HIsmelt process. It will also be appreciated that the ores can be in the form of iron ore fines.

The vessel 11 has a hearth that includes a base 12 and sides 13 formed from refractory bricks, side walls 14, which form a generally cylindrical barrel extending upwardly from the sides 13 of the hearth, and a roof 17. Water-cooled panels (not shown) are provided for transferring heat from the side walls 14 and the roof 17. The vessel 11 is further provided with a forehearth 19, through which molten metal is continuously discharged during smelting, and a tap-hole 21, through which molten slag is periodically discharged during smelting. The roof 17 is provided with an outlet 18 through which process off gases are discharged.

In use of the vessel 11 to smelt iron ore tines to produce molten iron in accordance with the HIsmelt process, the vessel 11 contains a molten bath of iron and slag, which includes a layer 22 of molten metal and a layer 23 of molten slag on the metal layer 22. The position of the nominal quiescent surface of the metal layer 22 is indicated by arrow 24. The position of the nominal quiescent surface of the slag layer 23 is indicated by arrow 25. The term "quiescent surface" is understood to mean the surface when there is no injection of gas and solids into the vessel 11.

Figure 3:
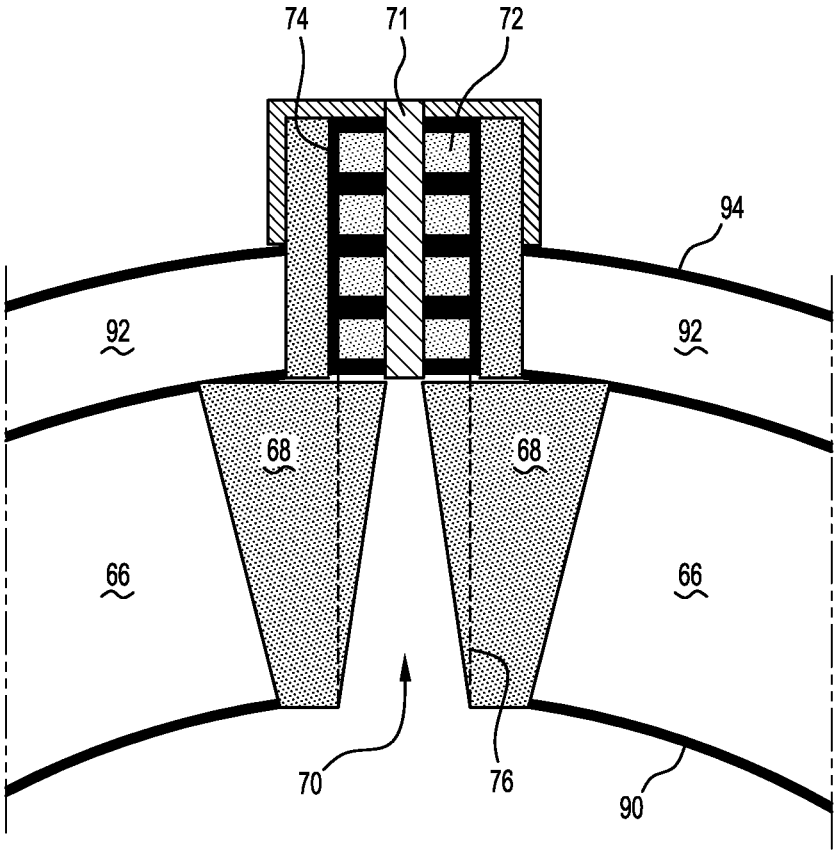
FIG. 3 is a schematic horizontal cross-section through the vessel in FIG. 1 in the plane indicated by arrows III-III showing the level of molten metal and slag during a slag drain before maintenance in accordance with an embodiment of the invention.

The vessel 11 is provided with solids injection lances 27 that extend downwardly and inwardly through openings (not shown) in the side walls 14 of the vessel and into the slag layer 23. The solids injection lances 27 are described in more detail in relation to FIGS. 3 and 4. Two solids injection lances 27 are shown in FIG. 1. However, it can be appreciated that the vessel 11 may have any suitable number of such lances 27. In use, heated iron ore fines and ambient temperature coal (and fluxes, typically lime) are entrained in a suitable carrier gas (such as a free oxygen-deficient carrier gas, typically nitrogen) and are separately supplied to the lances 27 and co-injected through outlet ends 28 of the lances 27 into the molten bath and preferably into metal layer 22. The following description is in the context that the carrier gas for the iron ore fines and coal is nitrogen.

The outlet ends 28 of the solids injection lances 27 are above the surface of the metal layer 22 during operation of the process. This position of the lances 27 reduces the risk of damage through contact with molten metal and also makes it possible to cool the lances by forced internal water cooling, as described further below, without significant risk of water coming into contact with the molten metal in the vessel 11.

The vessel 11 also has a gas injection lance 26 for delivering a hot air blast into an upper region of the vessel 11. The lance 26 extends downwardly through the roof 17 of the vessel 11 into the upper region of the vessel 11. In use, the lance 26 receives an oxygen-enriched hot air flow through a hot gas delivery duct (not shown), which extends from a hot gas supply station (also not shown).

The vessel 11 further includes a slag drain hole 60 in the side 13 of the base 12 (FIG. 2) which is, under quiescent conditions, at a level of the interface between the metal layer 22 and slag layer 23. Slag is drained by drilling a channel 70 (FIG. 3) through a monolithic refractory block 68 which forms part of the refractory lining 66. The channel 70 enables the slag to flow from the vessel 11, along a launder (not shown) and into a nearby containment pit (not shown).

Figure 2:
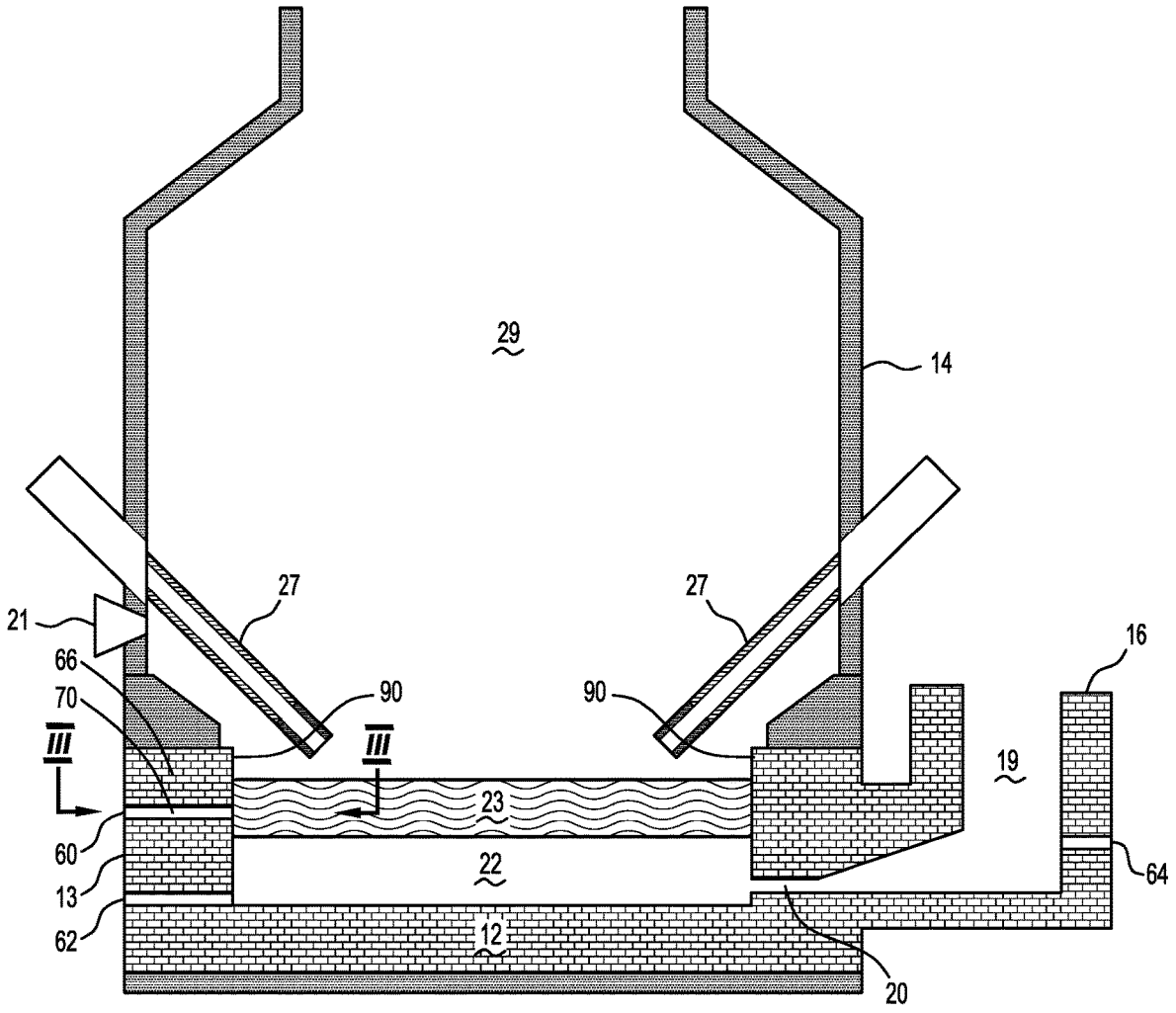
FIG. 2 is a vertical cross-section through the slag drain and the side wall of a section of the direct smelting vessel in FIG. 1.

The vessel 11 further includes an end-tap metal drain hole 62 in the side 13 of the base 12 and adjacent the floor of the vessel 11 (FIG. 2). In the event of the need to fully drain the metal, the slag is first drained and then a channel is drilled through the refractory lining 66 so that molten metal is able to flow from the vessel 11 via the end-tap metal drain hole 62. The metal is drained via a separate launder into a separate containment pit (not shown).

The typical approach to maintaining the slag drain hole 60 involves draining slag and metal from the vessel and allowing the vessel 11 to cool so that maintenance can be carried out on a cold vessel. More specifically, this involves removing refractory brickwork surrounding a monolithic slag drain block 68 (FIGS. 3 and 4) and removing the block 68. The block 68 and the refractory brickwork are then replaced. This is an extensive operation that requires access to the interior of the vessel 11, which, in turn, requires the vessel 11 to be cold. When the slag drain block 68 is replaced, the slag drain channel 70 is sealed with plugging mass or other appropriate material, typically tar or phenolic-based plugging mass, in preparation for restarting the direct smelting process. When the direct smelting process is operating, the slag is drained according to the typical method described above, i.e. by drilling a channel 70 (FIG. 4) through a monolithic refractory block 68 and which channel 70 is resealed by injection of plugging mass into the channel 70.

The applicant has realized that this can be avoided by tapping some slag and metal and retaining some slag and metal in the vessel 11 for the duration of the maintenance work. This is a significant advantage because it avoids the down-time associated with a vessel shut-down. A further significant advantage is that the direct smelting process to be restarted without input of molten metal from an external source. This simplifies plant operation and reduces costs because it avoids the need to prepare a separate charge of molten iron on site and transfer it safely into the vessel 11.

There are two aspects to this method. The first aspect is tapping the molten bath from a full inventory to the extent required for the maintenance work. In this regard, the slag is tapped initially via the tap-hole 21 and then via the slag drain hole 60 until the tip of the lances 27 are above slag level 23. Hydrostatic pressure on the underlying molten metal is reduced so that the level of metal in the forehearth 19 recedes from the level of an overflow weir 16. However, the slag layer 23 will still be above the level of the slag drain hole 60 and the metal level 24 at the slag drain level 60.

The surface 24 is further lowered to a level below the slag drain 60 by sealing the slag drain hole 60, opening the trim tap hole 64, increasing the pressure in the gas space 29 above the molten bath and opening the trim tap hole 64 in the forehearth 19. The elevated pressure in the vessel 11 forces molten metal to flow from the vessel 11, through the forehearth connection 20, into the forehearth 19 and out through the trim tap hole. The pressure is increased by 5 to 40 kPa, and typically around 20 kPa. Sufficient molten metal is tapped via the trim tap hole 64 so that the level of the molten bath, once the pressure in the gas space 29 is reduced to atmospheric pressure, will be sufficiently below the level of the slag drain hole 60 to expose refractory lining surrounding the slag drain hole 60 that is corroded and that needs to be replaced. Additionally, the level of molten metal in the forehearth will also decrease so as to also provide safe access to maintain metal trim tap hole 64.

Figure 4:
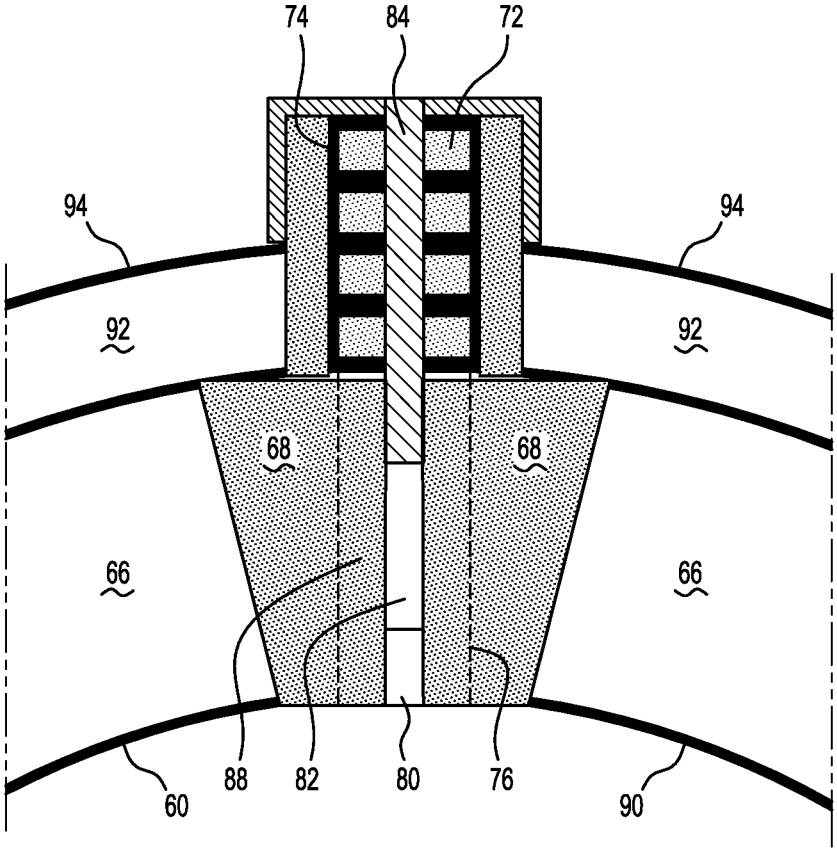
FIG. 4 is a schematic vertical cross-section through the vessel in FIG. 1 showing the level of molten metal and slag during a slag drain after maintenance in accordance with an embodiment of the invention.

When sufficient molten metal is tapped and the affected refractory lining is exposed, the pressure in the vessel 11 is brought into equilibrium with the ambient air pressure to enable a volume 76 of the refractory lining 66 to be excavated by core drilling. The excavation opens the vessel 11 to direct access from outside the vessel 11. The volume 76 is selected to encompass the corroded refractory lining 66 along the inner hot wall surface 90 of the refractory lining 66 as shown in FIG. 4. Given that the volume extends to a level below the slag channel it is important for the molten bath to be tapped to a level that is below the level of the lowermost point of the volume 76 in order to contain slag in the vessel 11 during excavation and replacement of the slag drain hole 60 of the refractory lining.

With the volume 76 excavated, a replacement refractory sleeve 88 is installed into the volume (FIG. 4). Replacement refractory tiles 72 are installed behind the refractory sleeve 88. Each tile has a central opening 71 (through which slag can be tapped) which is aligned with the channel 70 in the refractory sleeve 88 to form a continuous channel from the inner wall surface 90 of the refractory lining 66 to the exterior of the vessel. The tiles are held in place by refractory cement 74.

Contrary to the typical method of sealing the slag drain hole slag 60 with plugging mass, the slag channel 70 is sealed by locating a pre-formed refractory material, in the form of core-drilled refractory brick 80 in the end of the channel 70 so it is exposed to the interior of the vessel 11. The brick 80 is formed of a chrome-based refractory material. It is manually located in the end of the channel 70 by pushing it into position with a bar or rod so that the exposed end of the refractory brick 80 is substantially flash with the exposed end surface of the refractory sleeve 88.

High-alumina content ramming 82 is located in the sleeve 70 behind the refractory brick 80 to further seal the sleeve 70 under the high-temperature conditions experienced in the refractory lining 66. It will be appreciated, however, that other forms of material that can withstand high temperatures may alternatively be used instead of the high-alumina content ramming 82. The outer part of the sleeve 70 is sealed with packing 84 in the form of phenolic mud. However, other suitable materials for sealing the rear end of the sleeve 70 may alternatively be used.

In the event the refractory brick 80 projects slightly from or is recessed slightly from the inner wall surface, slag washing will corrode edges or corners that stand proud of the inner wall surface and the sleeve 88. Otherwise, it is expected that the corrosion of the brick 80 and the sleeve 88 will be similar to the corrosion of the refractory lining 66 in the vessel 11.

In order to drain slag via the reconstructed slag drain 60, the brick 80, the ramming 82 and the plugging mass seal 84 are excavated by drilling with a pricker (not shown) or with another suitable drill. Once a slag drain is completed, a new brick is placed at the end of the channel 70 and the channel 70 is sealed in the manner described above. This process can be repeated as required until it becomes necessary to replace the sleeve 88. In which case, the process for replacing the sleeve 88 as described above is utilised. It is expected that the drilling during each slag drain may increase the cross-section of the channel 70. At some point, the brick 80 will not properly seal the channel 70 at a comfortable location into the channel 70. It is at this point that the sleeve will be replaced by the method described above.

The applicant recognises that sealing the sleeve 88 with the refractory brick 80 reduces the corrosive effect of the high-FeO slag during normal production times. Specifically, the refractory brick 80 is similarly resistant to corrosion by the high-FeO slag as the refractory sleeve 88 and the remainder of the refractory lining 66. This means that, during normal production, the sleeve 88 and the channel 70 are less susceptible to corrosion than when the channel 70 is filled with phenolic mud which dissolves away gradually to expose the channel 70. It is expected that this reduced susceptibility to corrosion will result in the slag drain being less likely to form a funnel-shaped corrosion pattern.

It is also expected that reduced corrosion during production times will reduce the frequency of slag drain maintenance. While corrosion of the slag drain will still occur as a result of draining slag, the above described method for replacing the sleeve 88 can be used whenever required.

Whilst a number of specific apparatus and method embodiments have been described, it should be appreciated that the apparatus and method may be embodied in many other forms.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A method of sealing a slag drain in a direct smelting vessel for containing a molten bath of slag and molten metal, the direct smelting vessel comprising at least one solids injection lance extending downwardly and inwardly through a refractory-lined side wall of the vessel for injecting metalliferous material and/or carbonaceous material, the slag drain comprising a slag drain channel extending from an inlet end at an inner surface of the refractory-lined side wall in the direct smelting vessel, the inlet end being exposed to the molten bath, to a location at or near an exterior of the direct smelting vessel, the method comprising locating a pre-formed refractory material at the inlet end of the channel, wherein the pre-formed refractory material is positioned substantially flush with the inner surface of the refractory-lined side wall so that it is exposed to the molten bath and sealing the channel with sealing material downstream of the pre-formed refractory material wherein the pre-formed refractory material has corrosion resistant properties that are similar to a surrounding refractory lining.

2. The method defined in claim 1, wherein the sealing material introduced downstream of the pre-formed refractory material includes an alumina-based plugging material.

3. The method defined in claim 2, wherein the sealing material introduced downstream of the pre-formed refractory material includes tar or phenolic-based plugging mass downstream of the alumina-based plugging material.

4. The method defined in claim 1, wherein the pre-formed refractory material is a solid chrome-based refractory material at the time that it is located within the channel.

5. The method defined in claim 1, wherein the pre-formed refractory material may be a refractory brick.

6. The method defined in claim 1, further comprising maintaining a slag drain channel formed in refractory lining of a direct smelting vessel that contains a molten bath of slag and molten metal and that has a forehearth with an overflow weir for discharging molten metal, wherein the maintaining includes:

(a) reducing the slag and metal inventory from the inventory under normal operating conditions;

(b) temporarily plugging the slag drain channel for stopping slag flow when a level is deemed low enough for allowing further maintenance activities;

(c) opening a tap hole located in the forehearth, below the overflow weir, for tapping further metal;

(d) temporarily increasing the gas vessel pressure in the direct smelting vessel to cause molten metal to flow from the direct smelting vessel into the forehearth to further decrease a metal level in the vessel to be below the slag drain and the forehearth tap hole when the gas pressure is reduced to atmospheric pressure;

(e) adjusting the pressure in the vessel to be atmospheric pressure and removing a section of refractory lining surrounding the slag drain channel to form an enlarged channel and installing a refractory sleeve in the enlarged channel, the sleeve including a channel for draining slag; and (f) sealing the slag drain channel by locating a pre-formed refractory material at the inlet end of the channel so that it is exposed to the molten bath and sealing the channel by introducing a sealing material downstream of the pre-formed refractory material.

7. The method defined in claim 6, including step (f) as a further step that includes plugging the forehearth tap hole and sealing the slag drain channel by locating a pre-formed refractory material at the inlet end of the channel so that it is exposed to the molten bath.

8. The method defined in claim 6, wherein the pre-formed refractory material is a chrome-based refractory brick.

9. The method defined in claim 6, wherein the method includes maintaining sufficient slag and molten metal in the vessel to enable commencement of a direct smelting process without additional input of molten metal to the vessel from an external supply.

10. The method defined in claim 6, wherein reducing the slag inventory includes tapping slag from a tap hole above the slag drain channel.

11. The method defined in claim 6, wherein reducing the slag inventory includes draining slag via the slag drain channel during the temporary pressure increase, such that, after the temporary pressure increase, the level of the molten bath is below a level of the slag drain channel.

12. The method defined in claim 6, wherein the method includes causing the temporary pressure increase by controlling a flow of vessel off-gas through downstream off-gas processing operations.

13. The method defined in claim 6, wherein the pre-formed refractory material is positioned substantially flush with the inner surface of the refractory-lined side wall.

14. The method defined in claim 6, wherein the pre-formed refractory material has corrosion resistant properties that are similar to the surrounding refractory lining.

15. The method defined in claim 6, wherein the sealing material introduced downstream of the pre-formed refractory material includes an alumina-based plugging material.

16. The method defined in claim 6, wherein the sealing material introduced downstream of the pre-formed refractory material includes tar or phenolic-based plugging mass downstream of an alumina-based plugging material.

* * * * *